United States Patent [19]

Graf et al.

[11] 4,344,754

[45] Aug. 17, 1982

[54] WATER COOLED VERTICAL GAS DISTRIBUTOR

[75] Inventors: Harlan G. Graf; Harry R. Janssen; Don L. Edwards, all of Ponca City, Okla.

[73] Assignee: Conoco Inc., Ponca City, Okla.

[21] Appl. No.: 236,422

[22] Filed: Feb. 20, 1981

[51] Int. Cl.[3] ..... F27D 1/12; F22B 37/00; C21B 7/10

[52] U.S. Cl. ..... 432/233; 122/6.6; 266/189

[58] Field of Search ..... 432/233, 79, 95; 266/189, 197; 122/6.6

[56] References Cited

U.S. PATENT DOCUMENTS 2,593,345 4/1952 Robinson ..... 432/197 X 3,954,391 5/1976 Gottlieb ..... 432/95

*Primary Examiner*—John J. Camby

*Attorney, Agent, or Firm*—Richard W. Collins

[57] ABSTRACT

A vertically disposed gas distributor for injection of combustion air into a shaft kiln. The air distributor extends from the upper portion of the shaft kiln to an intermediate combustion zone, and includes at least one cooling water inlet line and at least one cooling water return line. The cooling water inlet and return lines extend along and adjacent to the outer surface of a central gas conduit. The distributor includes an insulation layer covering the central gas conduit and the cooling water inlet and return lines, and includes a baffle member which directs cooling water from the cooling water inlet line around the outlet end of the gas conduit and to the cooling water return line.

1 Claim, 5 Drawing Figures

WATER COOLED VERTICAL GAS DISTRIBUTOR

BACKGROUND OF THE INVENTION

This invention relates to apparatus for calcining of particulate materials, and more particularly to calcining of material such as petroleum coke in vertical shaft kilns.

Petroleum coke is conventionally calcined at high temperature to drive off volatile materials and moisture, and to alter the coke properties so that it may be made into useful products. Most commercial calciners are of the inclined rotary kiln type, but there are advantages in using a vertical shaft kiln for this purpose. A thorough description of a vertical shaft kiln and its operation is found in U.S. Pat. No. 4,251,323.

One petroleum encountered in operating an internally-fired large diameter vertical shaft kiln is obtaining good distribution of injected combustion air. Injection of air through holes in the kiln wall does not provide sufficient air to the central part of the kiln.

The prior art relating to gas injection in shaft kilns, in addition to the above-mentioned U.S. Pat. No. 4,251,323, includes U.S. Pat. No. 2,933,297, which describes horizontal water-cooled gas inlets extending across the interior of the kiln. These horizontal distributors, however, interfere with the downwardly flowing bed of particulate material, and in cases where very high temperatures are required, such as in calcining and desulfurizing petroleum coke at from 1300° to 1600° C., the heat losses from air distributors of the type shown in U.S. Pat. No. 2,933,297 are excessive, and the metal in the distributors is subject to getting too hot to maintain structural integrity.

Thus, a need exists for an air injection system capable of injecting combustion air uniformly throughout the cross section of a vertical shaft kiln and capable of withstanding the severe temperatures encountered in calcining and desulfurizing petroleum coke. Such a system is provided by the present invention.

SUMMARY OF THE INVENTION

According to the present invention, gas conduits adapted to extend from the upper section of a shaft kiln into an intermediate combustion zone in the kiln are provided. Cooling water inlet and return lines extending along the length of and adjacent to the gas conduits are provided. An insulation layer covers the gas conduits and cooling water lines, and a baffle between the cooling water inlet and return lines directs cooling water around the outlet end of the gas conduit.

DESCRIPTION OF THE PREFERRED EMBODIMENT

Figure 1:
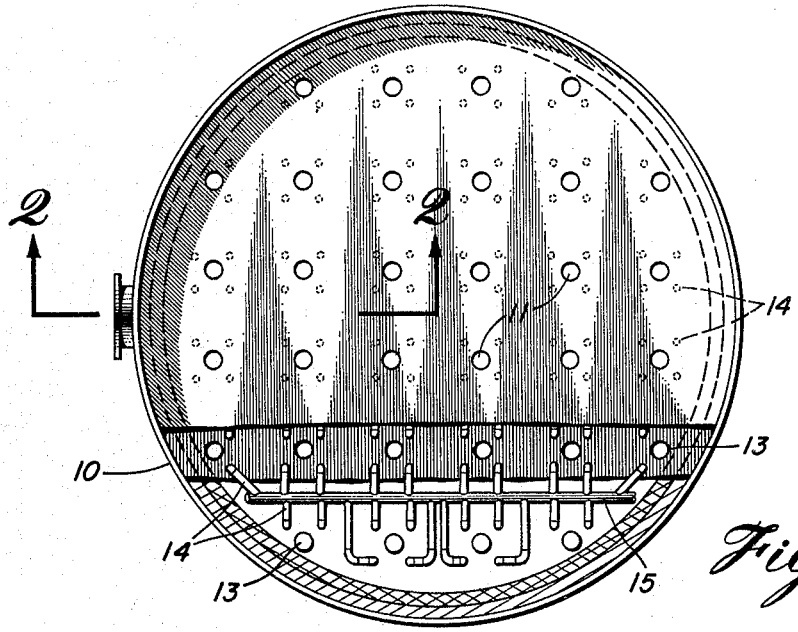
FIG. 1 is a top plan view, partly cut away, of the upper portion of a vertical kiln showing a pattern of feed distributors and a gas header.
Figure 2:
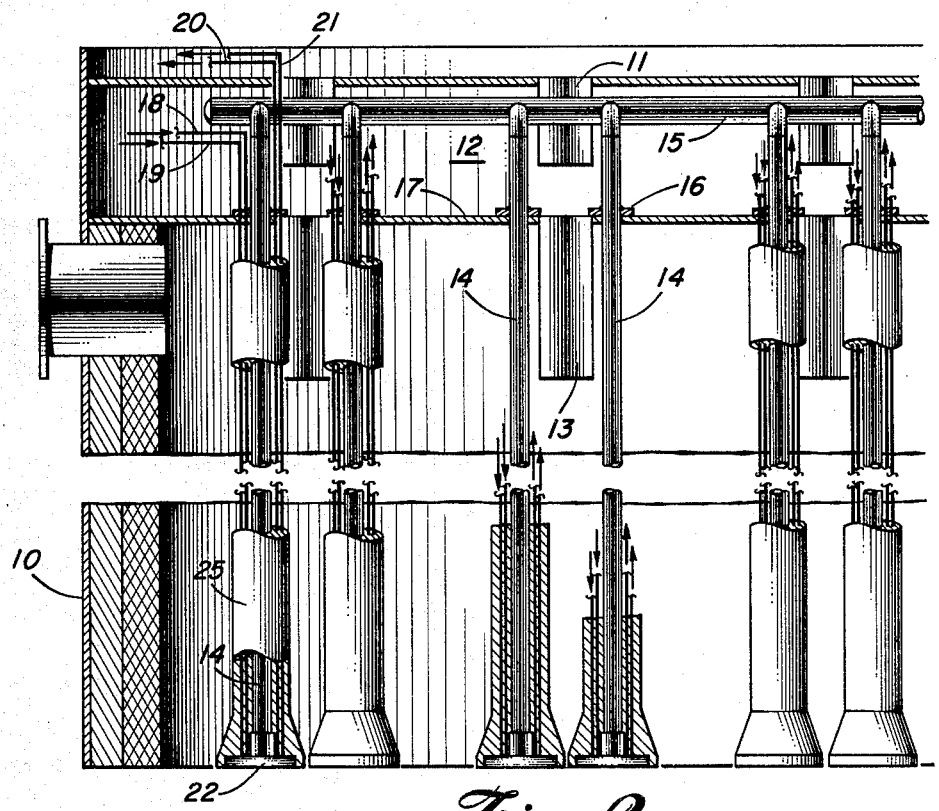
FIG. 2 is an enlarged cross section taken along the Line 2—2 of FIG. 1.

The preferred embodiment of a gas distributor in accordance with the invention is illustrated in FIGS. 2 through 5. The arrangement of these gas distributors in a vertical shaft kiln is shown in FIGS. 1 and 2.

As seen in FIGS. 1 and 2, kiln 10 is shown having a pattern of upper feed distribution inlet downcomers 11 spaced about the bottom of a feed hopper bin (not shown).

Particulate feed, such as coke to be calcined, passes from the feed hopper through upper downcomers 11 through seal gas chamber 12 (FIG. 2) and then through lower downcomers 13 and finally into the main body of kiln 10 where a slowly moving bed of coke passes downwardly through the kiln.

Arranged about each lower downcomer 13 is a pattern of gas distributor conduits 14.

A gas header 15 supplies gas to the inlet end of each gas distributor conduit 14. Retaining rings 16 fastened to conduit 14 position each gas distributor conduit by resting against the bottom plate 17 of seal gas chamber 12.

Figure 3:
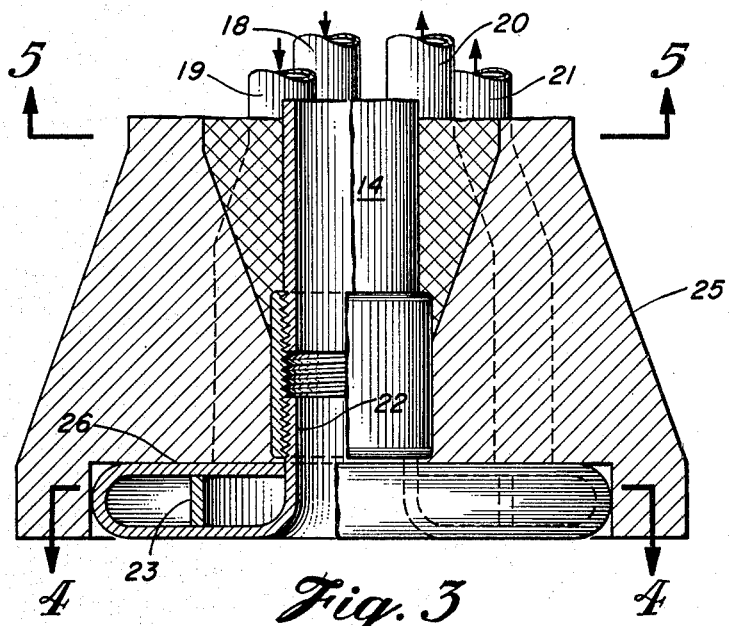
FIG. 3 is an enlarged side elevation, partly broken away, showing the details of the outlet end of the gas distributors.
Figure 4:
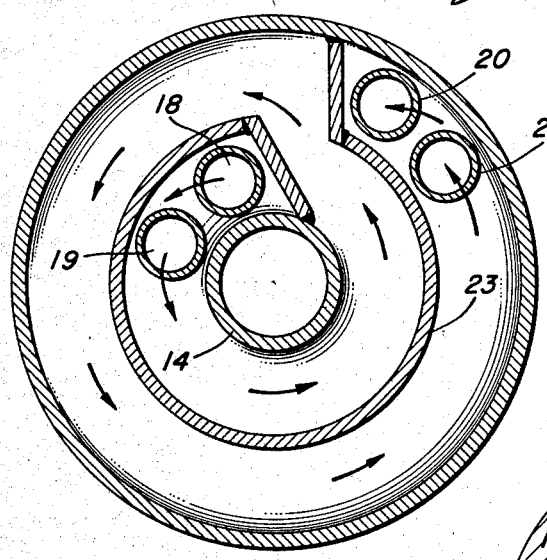
FIG. 4 is a cross section taken along the Line 4—4 of FIG. 3.
Figure 5:
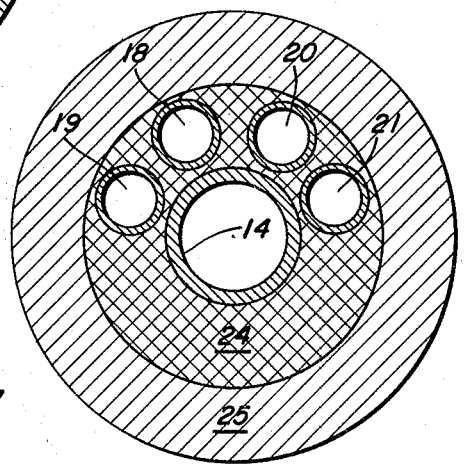
FIG. 5 is a cross section taken along the Line 5—5 of FIG. 3.

Referring now to FIGS. 2 through 5, each gas distributor conduit 14 has two cooling water inlet lines 18 and 19 and two cooling water return lines 20 and 21 associated therewith. As best seen in FIGS. 3 and 5, cooling water lines 18, 19, 20, and 21 extend along and adjacent to the main longitudinal section of gas distributor conduit 14. At the outlet end of conduit 14, a fitting 22 is provided. Cooling water inlet lines 18 and 19 discharge into fitting 22. A baffle 23 in fitting 22 directs cooling water from lines 18 and 19 around the outlet end of conduit 14 in a spiral flow path to cooling water outlet lines 20 and 21.

Referring to FIG. 5, a first layer of castable insulation 24 surrounds conduit 14 and all the cooling water lines. An outer layer of performed insulation 25 surrounds the inner layer of castable insulation.

Referring to FIG. 3, the top surface 26 of fitting 22 extends outward radially from the outlet end of conduit 14 and provides support for the outer layer of preformed insulation.

The operation of the gas distributors in accordance with the invention will now be described as it would apply to a procedure calcining petroleum coke, although it will be apparent that the system is applicable in other operations where it is desired to distribute an injected gas into a heated process vessel.

Green particulate coke to be calcined passes from a feed hopper bin (not shown) through upper downcomers 11 into seal gas chamber 12 and then through lower downcomers 13 into the body of shaft kiln 10 to provide a downwardly moving bed of coke. A combustion zone is established at an intermediate zone in the kiln near the outlets of conduits 14. In order to maintain the combustion, air from header 15 passes through conduits 14 to the combustion zone. Because of the extreme temperatures developed, conduits 14 must be protected. Insulation 24 and 25 protects conduits 14 to some extent, but additional cooling is required. This is provided by cooling water which runs from lines 18 and 19 to end fitting 22, around baffle 23, and back through lines 20 and 21. The combination of insulation and cooling water protects conduits 14 from the extreme temperatures encountered. The dimensions, flow rates and materials used can be easily determined for a given set of conditions. As illustrated, two separate cooling water lines are provided. This enables a high rate of cooling water flow without extending the cooling water lines too far out into the insulating material, thereby providing better protection to the conduit 14. As will be apparent, cooling water lines shaped to conform to the outer surface of conduits 14 would provide maximum protection while extending a minimum distance outward into the insulation.

The foregoing detailed description of the preferred embodiment of the invention is for the purpose of describing the invention. It will be apparent that numerous variations and modifications could be made to the system as described without departing from the scope of the invention, which is defined in the appended claims.

We claim:

1. A gas distributor for injecting gas into a hot process vessel, said distributor comprising:

(a) a central metal conduit having an outlet end, a main longitudinal body section, and an inlet end adapted to be connected to a gas source;

(b) a plurality of cooling water inlet lines extending along and adjacent to the outer surface of said main longitudinal body section;

(c) a plurality of cooling water return lines extending along and adjacent to the outer surface of said main longitudinal body section, said return lines being spaced from said inlet lines;

(d) an insulation layer covering said main longitudinal body section and said water inlet and return lines; and (e) baffle means attached to the outlet end of said central metal conduit, said baffle means being adapted to receive cooling water from said cooling water inlet lines, direct the cooling water around the outlet end of said distributor, and discharge the cooling water to said cooling water return lines.

* * * * *